United States Patent [19]

Tutt et al.

[11] 4,126,020

[45] Nov. 21, 1978

[54] LOW INERTIA SHOE MACHINE TOOL SUPPORT

[75] Inventors: Kingsley J. Tutt, Birstall; William F. Willbond, Ratby; John Davies, Syston, all of England

[73] Assignee: USM Corporation, Farmington, Conn.

[21] Appl. No.: 827,070

[22] Filed: Aug. 23, 1977

[30] Foreign Application Priority Data

Aug. 24, 1976 [GB] United Kingdom ..... 35173/76

[51] Int. Cl.[2] ..... C14B 1/44; A43D 95/00

[52] U.S. Cl. ..... 69/6.5; 12/77

[58] Field of Search ..... 69/6.5; 12/1 R, 77, 12/17.2

[56] References Cited

U.S. PATENT DOCUMENTS

| | | | |
|---|---|---|---|
| 3,831,405 | 8/1974 | Vornberger | 69/6.5 |
| 3,843,985 | 10/1974 | Leonhardt | 12/77 X |
| 3,975,932 | 8/1976 | Vornberger | 69/6.5 |

*Primary Examiner*—Patrick D. Lawson

*Attorney, Agent, or Firm*—Donald N. Halgren; Richard B. Megley; Vincent A. White

[57] ABSTRACT

An automatic shoe bottom roughing machine has tool supports mounted on movable carrier arms to permit movement of the arms widthwise across the shoe bottom, the tool support being pivotable heightwise, both the tool supports and the arms being light in weight to reduce unnecessary movement or bounce in the tools, the machine including a one-way hydraulic damping arrangement effective to resist upward movement of the tools.

3 Claims, 6 Drawing Figures

LOW INERTIA SHOE MACHINE TOOL SUPPORT

BACKGROUND OF THE INVENTION

1. Field of the Invention

This invention relates to shoe machinery, and more particularly to inertia control devices on shoe roughing machines.

2. Prior Art

This invention is an improvement of the type of shoe machine illustrated in British patent specification No. 1,137,254. The prior machine performs a roughing operation on marginal portions of shoe bottoms. The machine comprises a shoe support, tool supporting means for supporting two rotary roughing tools in tandem relationship lengthwise of the shoe support, means for controlling the pressure applied between the tools and the bottom of a shoe supported by the shoe support, and means for effecting relative movement between the shoe support and the tool supporting means to permit the tools to operate progressively along marginal portions of the shoe bottom at opposite sides thereof.

In the prior machine, cam means in the form of a flat template controls the relative movement of the tools with respect to the shoe being operated upon. The movement controlled, extends lengthwise and widthwise of the shoe support. Fluid pressure operated means is provided to control the pressure between the tool and the shoe bottom, permitting control of the heightwise position of the tool with respect to the shoe.

The pressure between the tool and the shoe bottom is variable to permit efficient operation upon shoes having a pronounced lengthwise curvature, e.g. high-heeled ladies' fashion shoes. The tool, in progressing from the toe end to the heel end of a shoe, firstly operates "uphill" from the toe portion to the ball region of the shoe bottom, and thereafter operates "downhill" from the ball region to the waist region of the shoe bottom and towards the heel seat portion thereof. When the tool is operating "uphill", it will tend to "dig" into the material of the marginal portion of the shoe bottom, whereas on the "downhill" operation, it will tend, because the shoe bottom is in effect falling away from it, to "bounce". The facility of varying the pressure, as mentioned earlier, can be used successfully to avoid any uneven roughing which would otherwise result.

It has been found, however, that with the machine described, the mass of the tool supporting means gives rise to relatively high inertia forces, so that the operating speed of the machine may in some circumstances have to be set at a level which is lower than is acceptable to a shoe manufacturer.

It is one of the various objects of the present invention to provide an improved apparatus suitable for use in performing a roughing operation on marginal portions of shoe bottoms, permitting higher operating speeds of the machine than has previously been the case.

SUMMARY OF THE INVENTION

The present invention comprises a machine used for roughing marginal portions of shoe bottoms. The machine in its entirety includes a shoe support for supporting, bottom uppermost, a last carrying a shoe, and tool supporting means for supporting two rotary roughing tools in the form of radial wire brushes in tandem relationship lengthwise of the shoe support.

The invention is also applicable to a machine provided with a single rotary roughing tool.

The invention performs a roughing operation on marginal portions of shoe bottoms. The shoes are disposed on a shoe support for supporting a last carrying a shoe, the shoe support being movable relative to the tool supporting means. The tool supporting means comprises a carrier, movable towards and away from the shoe support, and a tool support carried by the carrier wherein a tool supported thereon can be moved relative to the carrier in a direction heightwise of the bottom of a shoe. The carrier of the tool supporting means, and the tool support are moved towards and away from the shoe support following the plan shape of the bottom of a shoe supported thereon, the tool support being moved heightwise of the shoe support according to the heightwise contour of such shoe bottom, whereby the tool support operates progressively along a marginal portion of the shoe bottom.

The invention additionally provides an adjustable resilient means which acts on the tool support to urge such tool into engagement with the bottom of a shoe supported thereon, wherein engagement of the tool with the shoe bottom varies according to the contour of such shoe bottom, but the heightwise position of the carrier in relation to the shoe support is constant, or substantially so.

The invention still further provides drive means for effecting rotation of a rotary roughing tool supported by the tool supporting means. The drive means comprises a rotary drive arrangement and an endless drive member interconnecting the rotary members.

The machine ordinarily includes a flat template having a shape corresponding to the plan shape of the bottom of a shoe to be operated upon.

The apparatus also comprises rotary roughing brushes which can readily be secured on their rotary shafts. The brush mounting comprises a hollow sleeve portion and a locking arrangement at one end thereof, wherein an end cap member can be secured on the sleeve portion. The end cap member serves to secure a hub portion of the brush on the sleeve portion. The locking arrangement includes a latching member, which is accommodated in the sleeve portion and which projects from said sleeve portion to engage and secure the end cap member. Another spring-urged locking member which is also accommodated in the sleeve portion, acts to hold the latching member in its operative position. The end cap member has an opening to permit access to the locking member. By retracting the locking member against the spring acting thereon, the latching member may be released out of its operative position and the end cap member can thus be quickly and easily released from said sleeve portion.

BRIEF DESCRIPTION OF THE DRAWINGS

The various objects and advantages of the invention will become clearer from the following detailed description, to be read with reference to the accompanying drawings, in which.

DESCRIPTION OF THE PREFERRED EMBODIMENT

Figure 1:
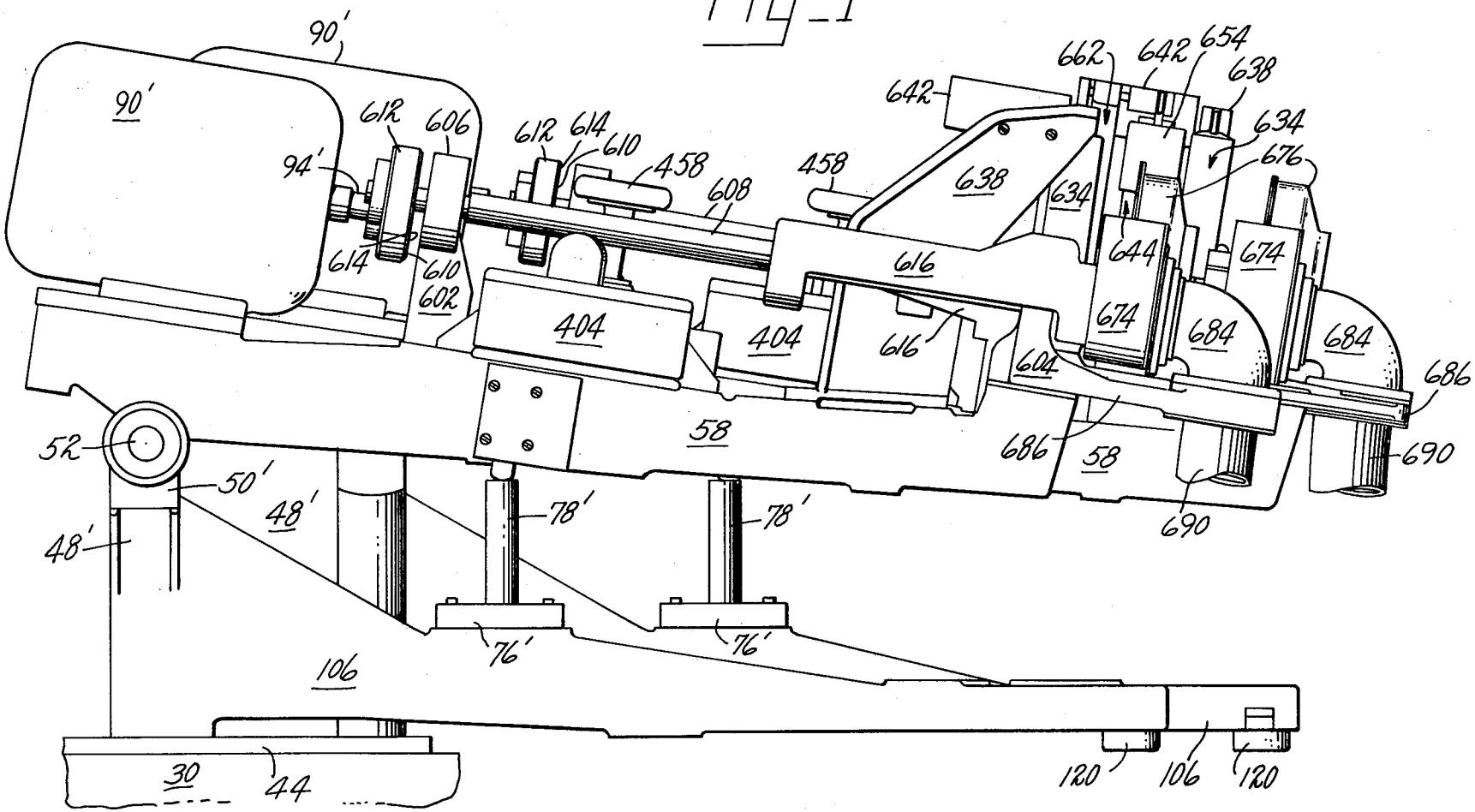
FIG. 1 is a side view, with parts broken away, of the machine, showing a tool supporting means thereof.

The present invention comprises a machine which is generally similar, except as hereinafter described, to the apparatus described in British patent specification No. 1,137,254. The machine performs a roughing operation on marginal portions of shoe bottoms in preparation for the attachment of outsoles thereto by means of cement. The machine comprises a frame 30 on which there is disposed a shoe support 32 for supporting, bottom uppermost, a last 24 having an insole 25, located on its bottom, and an upper 26 mounted thereon, having its upper margin 27 secured to the periphery of the insole 25, and a tool supporting means for supporting two radial wire brushes 38. The shoe support 32 is movable in a rectilinear path along an upper surface of the frame 30, and the brushes 38 are arranged in the path of movement of a shoe supported by the shoe support.

The tool supporting means comprises a plate 44 secured to the frame 30. The plate 44, has two arms 106, mounted for pivotal movement about vertical axes, spaced apart one at either side of the path of movement of the shoe support, and which extend one along either side of said path of movement. Each arm 106 carries a roll 120 at an end remote from the pivotal mounting. The rolls are arranged to track along opposite edges of a template (not shown) supported by template supporting means movable with the shoe support. The template is described in detail in the aforementioned British Patent Specification. In a cycle of operation of the machine, the arms 106 are urged inwardly, to bring the rolls 120 into engagement with the template, by fluid pressure operated means (not shown) acting on ends of the arms remote from the rolls 120. At the end of a cycle of operation, the fluid pressure means move the arms 106 outwardly, prior to the shoe support 32 being returned to an initial, loading position.

Each arm 106 has an upstanding portion 48' which carries a bracket 50'. The bracket 50' carries a transverse pivot pin 52. An arm 58, constituting a carrier of the machine, is mounted on each pin 52. Each arm 58 overlies its associated arm 106 and is mounted for pivotal movement therewith about a vertical axis. Each arm 58 is also mounted for pivotal movement about the axis of its pin 52, and is supported, in a limit position, shown in FIG. 1, on a rod 78' upstanding from a bracket 76' carried on the associated arm 106.

The initial heightwise position of each arm 58 can be set by a knob 458, permitting the setting of an initial datum position for each brush 38. Each knob 458 forms part of a device 404 for setting the heightwise position of each arm 58, and of the brush 38 therewith, not only for an initial setting but also for ensuring that each brush 38 returns to a given datum after a grinding operation has been performed. Each device 404, includes a first mechanism, effective first to cause relative movement between the arm 58, and brush 38, and a grinding stone support (not shown), whereby the brush 38 can be ground on a grinding stone (not shown), and thereafter displaced, and a second mechanism effective to move the arm 58 through a small distance towards the grinding stone support, after each grinding operation performed on the brush 38, permitting the operative surface of the brush to be disposed at its datum position.

Each arm 58 has two upstanding brackets 602, 604, secured thereto, spaced apart along the length of the arm 58, and carrying bearings 606 (one only shown in FIG. 1). The bearings 606 support a drive shaft 608, which constitutes part of drive means for the tools. Each shaft 608 is rotated by a motor 90' mounted on the arm, above the pivot pin 52. An output shaft 94' carries a toothed drive pulley 610, which is operatively connected, by means of a toothed endless belt 612, to a further toothed drive pulley 614 on the shaft 608.

Figure 6:
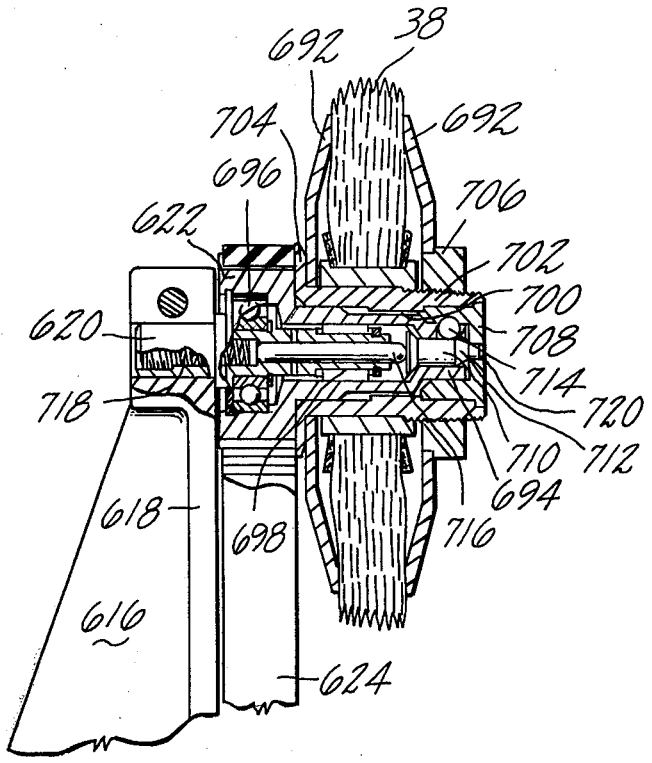
FIG. 6 is a fragmentary view showing a brush mounting of the machine.

Each shaft 608 pivotably supports a support member 616. Each support member 616 as shown in FIG. 3, has an inwardly extending arm portion 618 which carries a stub shaft 620 for a toothed drive pulley 622, and further carries a brush mounting as shown in FIG. 6, for the rotary roughing brush 38. The toothed drive pulley 622 is connected by means of a toothed endless belt 624 with a further toothed drive pulley 626, as shown in FIGS. 2 and 4, carried at the end of the drive shaft 608.

Figure 5:
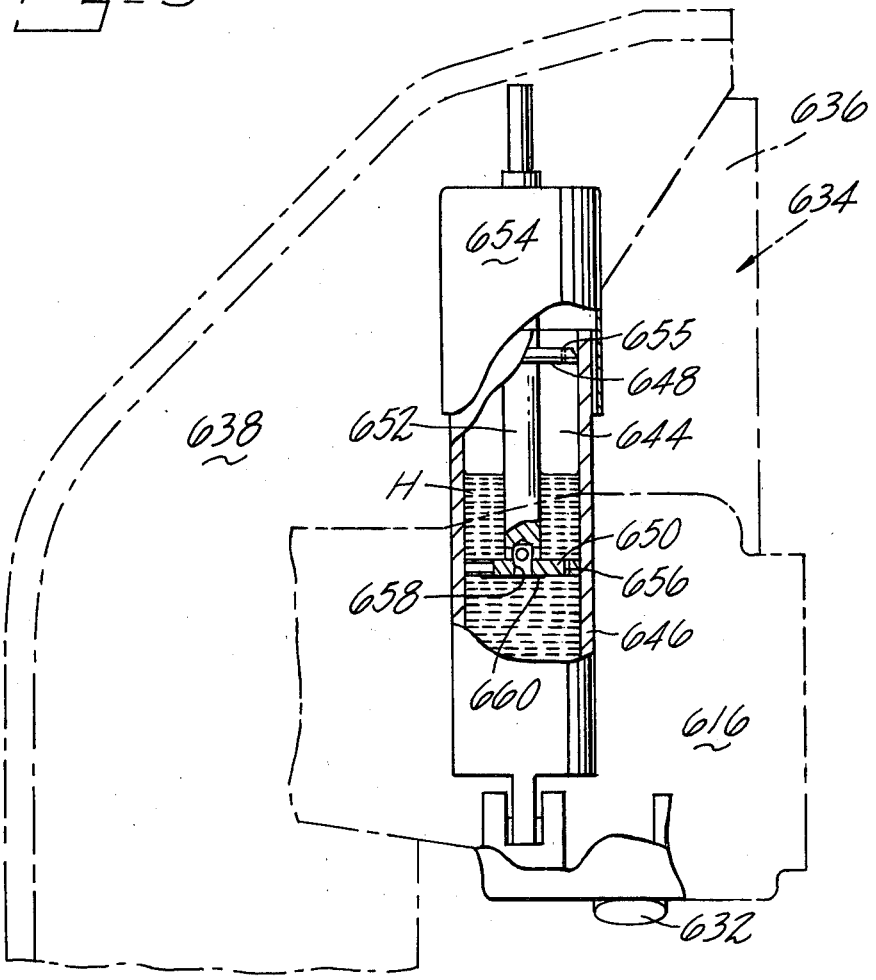
FIG. 5 is a fragmentary view of damping means acting on a tool support of the tool supporting means of the illustrative machine.

Thus, operation of each motor 90' causes the various drive pulleys and endless belts, to rotate each tool 38. Rotation of each brush effects an inward wiping action on marginal portions 27 of shoe bottoms being operated upon. The rotation of each shaft 608 tends to lift the arm portion 618 of each of the support members 616, as shown in FIGS. 5 and 6. This tendency is countered by the distribution of the weight of the member 616 and also by the weight of the brush 38. The lowermost position of the support member 616, and the tool 38 in relation to the arm 58 is determined by a stop surface 628 as shown in FIG. 2. The stop surface 628 comprises a web portion 630 of the bracket 604, and is engaged by a corresponding stop surface 632 provided at the underside of the support member 616.

Figure 2:
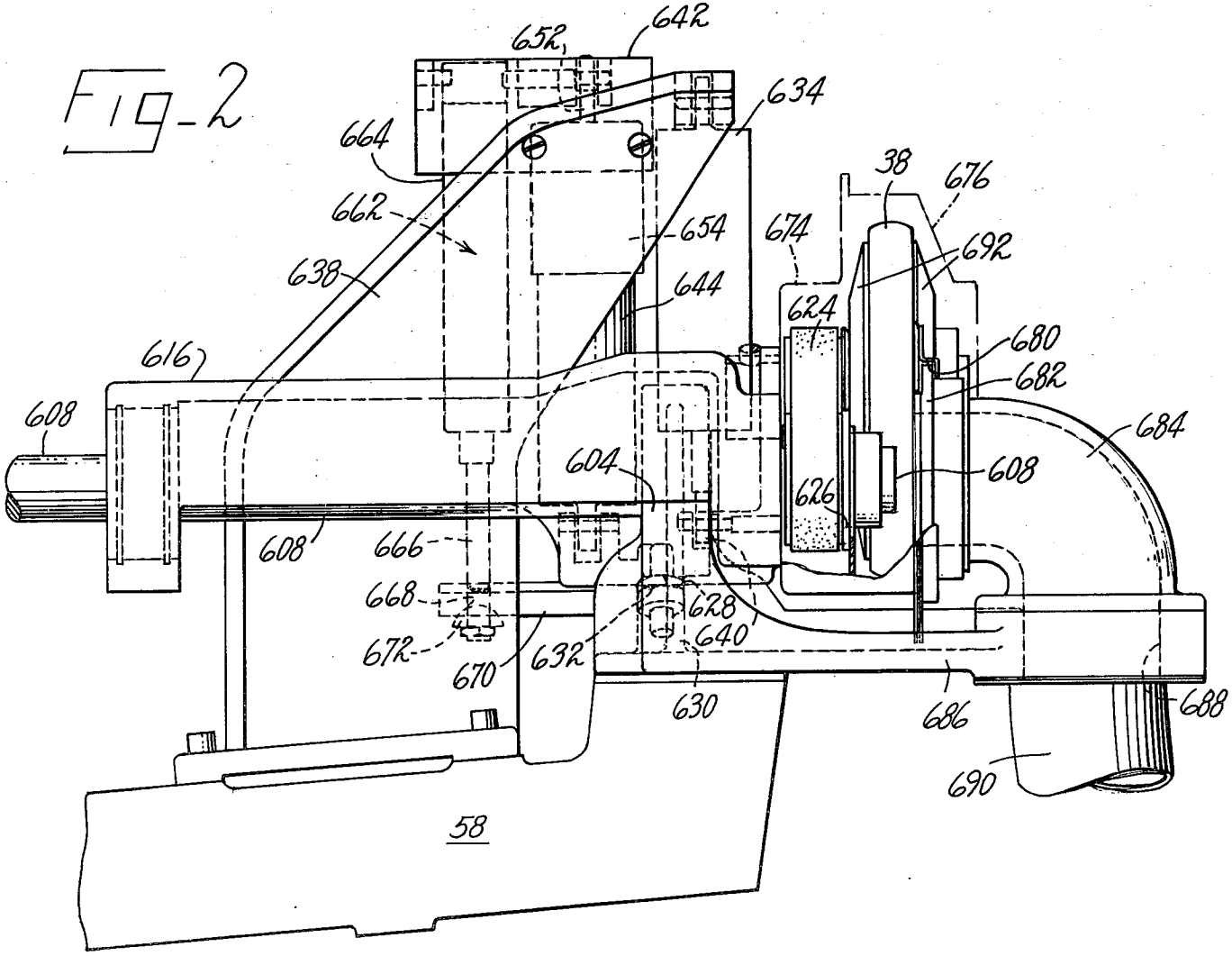
FIG. 2 is a side view, on an enlarged scale, showing parts of the tool supporting means shown in FIG. 1.
Figure 3:
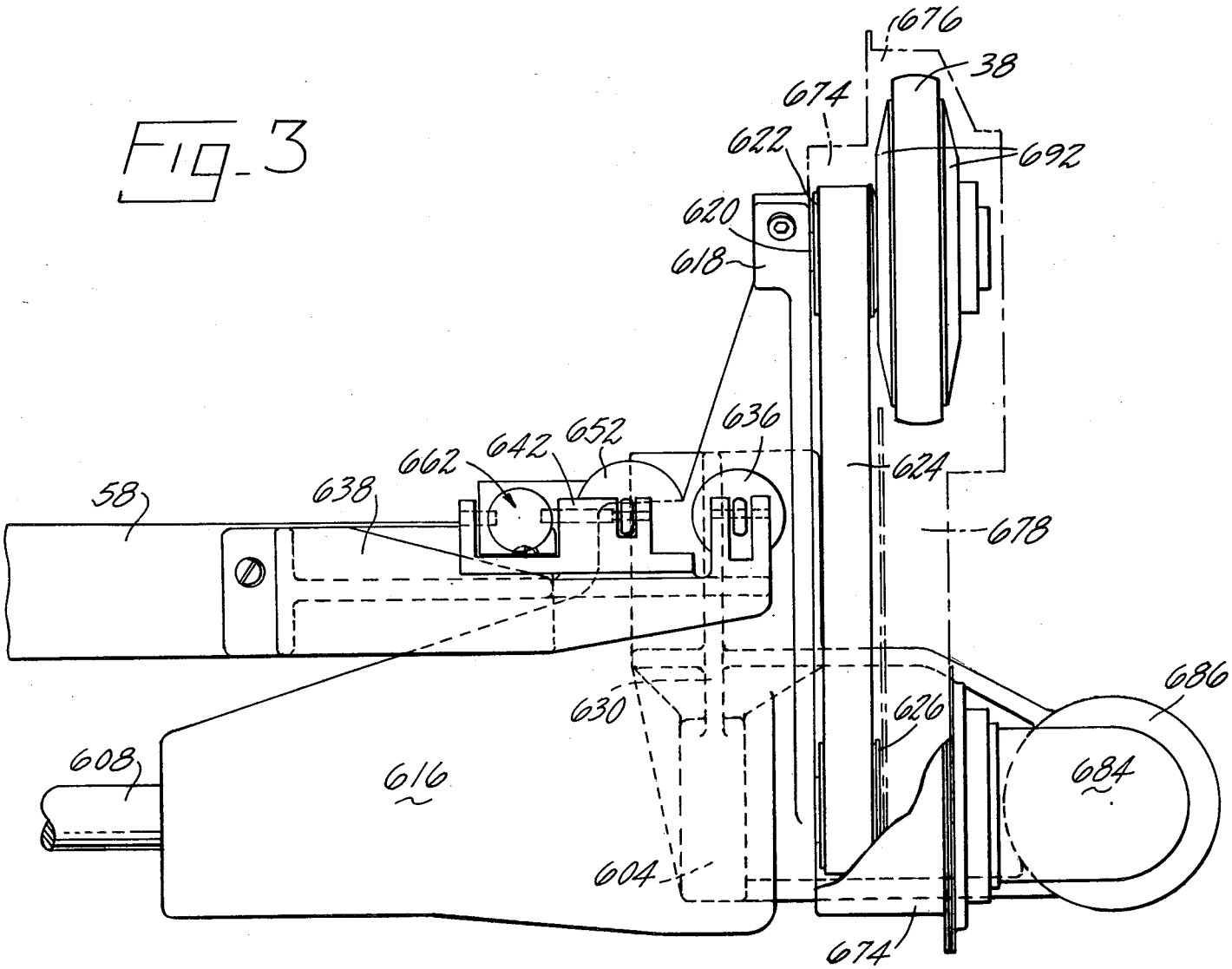
FIG. 3 is a plan view of the parts shown in FIG. 2.
Figure 4:
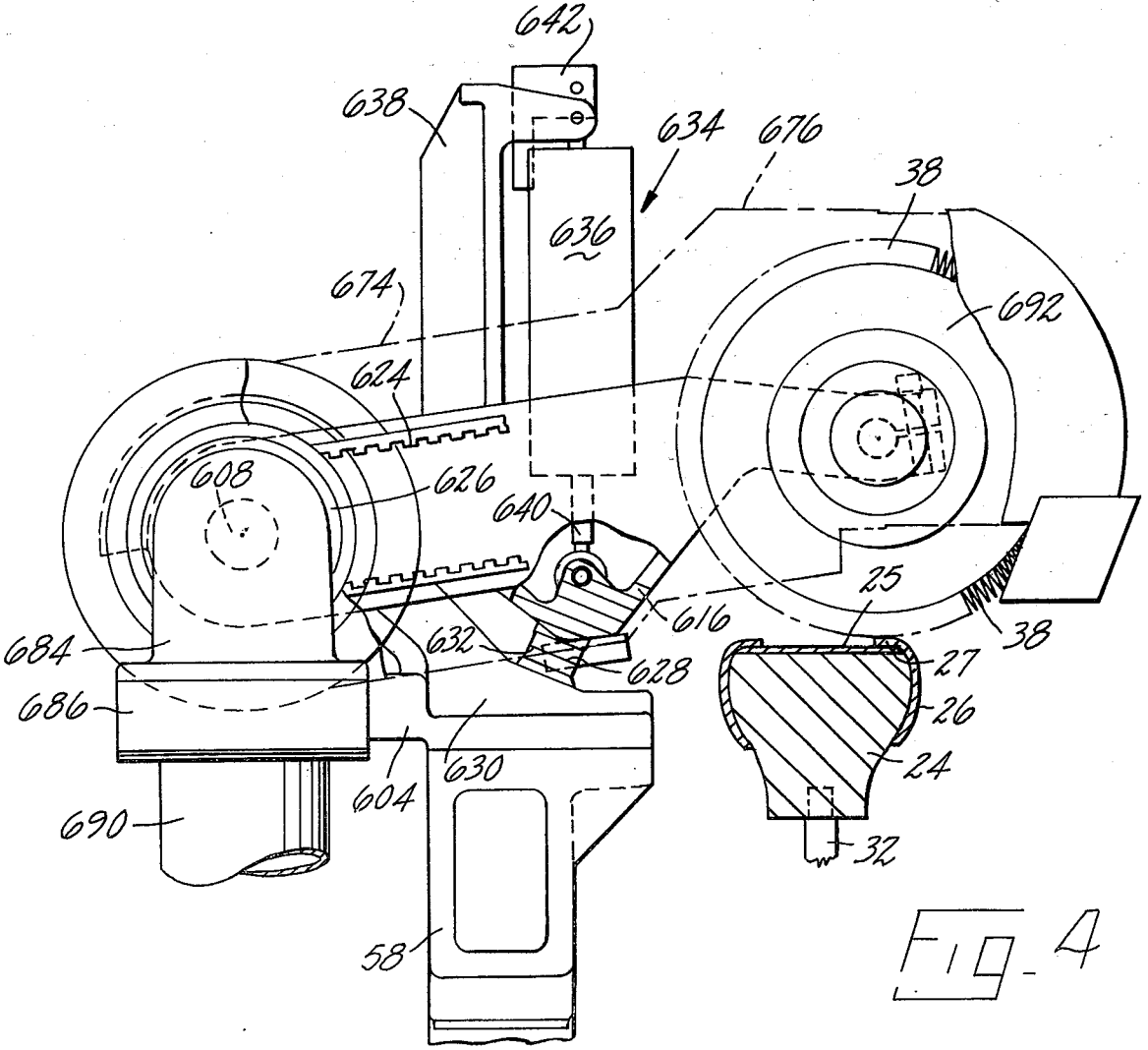
FIG. 4 is an end view of the parts shown in FIGS. 2 and 3.

In the operation of the present invention, each tool 38 is urged downwardly by means of a piston and cylinder arrangement 634 (constituting adjustable resilient means) as shown in FIGS. 2, 4 and 5. The cylinder 636 is pivotally secured to an upper end of a support member 638 secured on the arm 58. A piston rod 640 of said piston and cylinder arrangement is pivotally secured as shown in FIG. 4, to the support member 616. Thus, introduction of fluid under pressure to the upper end of the cylinder 636 is effective to urge the support member 616, and thus the brush 38 downwardly.

A lug 642 is secured at the upper end of the support member 638. A damping piston and cylinder mechanism 644 is arranged between the lug 642 and the support member 616, as shown in FIG. 4. This mechanism 644 comprises a cylinder 646 pivotally supported on the member 616 and has a double piston 648,650 mounted for movement therein, as shown in FIG. 5. A piston rod 652 has its upper end pivotally connected to the lug 642. A dust cover 654 shown in FIGS. 1 and 5, is also provided over the upper end of the cylinder 646, which is otherwise open. The upper piston 648 is provided with one or more bleed holes 655 through which air, or hydraulic oil may pass, during the operation of the mechanism. The lower piston 650 is similarly provided with bleed holes 656 through which hydraulic oil H can pass as the pistons 648,650 are moved relative to the cylinder 646. By restricting the flow of hydraulic fluid, upward movement of the cylinder 646 relative to the pistons is damped, so that any tendency of the support member 616, and thus of the tool 38 supported thereby, to "bounce" is also damped.

The piston 650 further comprises a central larger bore aperture 658 which is covered by a flap valve 660. In the operation of the machine, during upward movement of the cylinder 646, the pressure of the hydraulic fluid H beneath the piston 650 will force the flap valve 660 into operative aperture-closing condition. When, on the other hand, the cylinder 646 is moved downwardly relative to the piston 650, hydraulic fluid H will be drawn back into the chamber beneath the piston 650, such fluid acting against the flap valve 660 and causing it to open, thereby eliminating the damping effect of the arrangement 644. (The flap valve 660 is of course made of resilient material.) The piston and cylinder mechanism 644 is such that no damping of the downward movement of the tool 38 relative to the shoe support takes place.

The lug 642, as shown in FIG. 2, also supports a fluid pressure operated piston and cylinder arrangement 662, of which the cylinder 664 is pivotally carried by the lug 642. A piston rod 666 connected therewith loosely passes through an aperture 668 formed in an extension 670 of the support member 616. The lower end of the piston rod 666 carries a semi-spherical portion 672. Introduction of fluid under pressure to a lower end of the cylinder 664 is effective to raise the piston rod 666, and the semi-spherical portion 672 engages the underside of the extension 670 of the member 616 and causes the member 616, and the tool supported therewith, to be raised. Such admission of fluid takes place at the end of a roughing operation by the tool 38 at the bottom of a shoe. Because of the arrangement of the semi-spherical portion 672 and the loose fit of the piston rod 666 in the aperture 668, any heightwise movement of the support member 616 during a roughing operation of the machine is not impeded by the piston and cylinder arrangement 662.

The belts 624 of the drive means are each provided with a guard member 674 which also incorporates a hood or shroud 676 for each tool 38, as shown in FIG. 3. The hood constitutes part of dust extraction arrangement of the machine. The hood 676 has an extension 678 leading to an outlet aperture 680, shown in FIG. 2, having a center point which is generally coincident with the center of the axis of the shaft 608.

In order to ensure that the hood 676 does not interfere with the heightwise movement of the tool 38 in a roughing operation of the machine, the combined guard and hood 674,676 is itself mounted for pivotal movement about the axis of the shaft 608. The guard and hood 674,676 is fixed to the support member 616.

The outlet aperture 680 is provided with a lip and is received within a flange 682 of an elbow unit 684 which is secured on an extension 686 of the bracket 604. The extension 686 has an aperture 688 which can be aligned with the aperture of the elbow unit 684. The elbow unit 684 can be connected to a flexible tube 690 providing dust extraction means when it is connected to a suction source.

In the operation of the machine, the pressure of fluid applied to the piston and cylinder mechanism 634 does not vary during the course of the operation, but remains constant. Similarly, the arms 58 do not alter their heightwise position during a roughing operation. At the end of each roughing operation of each tool 38, the support member 616 raises the tool out of engagement with the shoe bottom by the admission of fluid under pressure to the piston and cylinder arrangement 662. Fluid under high pressure is admitted to the piston and cylinder arrangements 662 to lock the support members 616 with the stop surfaces 632 and 628 on the brackets 604. This prevents the mere pivoting of support members 616 and the raising of the brushes 38 relative to the arms 58.

The tools 38 are radial wire brushes, each comprising a plurality of radial bristles mounted on a hub and clamped between a pair of clamp plates 692. The operating surface provided by the bristles is radiused. By shaping the work-engaging surface, and by mounting the brushes for heightwise movement relative to the shoe support pivotally about the axis of the shaft 608, the portion of the work-engaging surface of the tool engaging the shoe bottom at any given time will have a constant radius, so that evenness of rough can more readily be achieved.

The brush mounting as shown in FIG. 6, on each support member 616 comprises a central sleeve member 694 supported by the stub shaft 620. The stub shaft 620 is provided with a thrust bearing 696 and a needle bearing 698 for supporting the sleeve member 694. The sleeve member 694 is formed integral with the pulley 622. The sleeve member has a forward splined portion 700 for receiving an internally splined hub member 702 of the brush 38. The brush 38 and its clamp plates 692 can be secured against an integral flange 704 of the hub member by a nut 706 threaded on to an externally threaded end portion of the hub member.

A locking arrangement for securing the brush 38, is provided at the forward end of the sleeve member 694. The locking arrangement cooperates with an end cap 708 secured inside the forward end of the hub member 702. The locking arrangement comprises a locking member in the form of a plug 710. The plug 710 is permitted limited sliding movement in a forward end portion, of reduced diameter, of the sleeve member 694. The plug 710 has a cam face 712 by which three latching members in the form of balls 714 can be urged into an operative condition. The balls 714 project through apertures formed in the end portion of the sleeve member and engage in recesses formed in the end cap 708, and are allowed to be moved into a retracted condition.

The plug 710 is urged forwardly to permit the balls 714 to move operative condition, by a plunger 716 accommodated within the stub shaft 620. The stub shaft 620 is hollow, and urged forwardly by a spring 718 also accommodated therewithin. When the plug 710 is in its forward condition, an end portion thereof projects through a cutout or aperture 720 formed centrally of the end cap. To release the balls 714, the plug 710 is urged rearwardly, e.g. by inserting a spike through the aperture 720, against the action of the spring 718 (to the left as shown in FIG. 6), and the brush 38 can then be removed from the sleeve member 694.

Having thus described my invention what I claim as new and desire to secure by Letters Patent of the United States is:

1. A machine for roughing the margin of an upper of a shoe assembly mounted on a movable shoe assembly support, said shoe assembly including a last having an insole located on its bottom and an upper mounted thereon having its margin secured to the periphery of the insole, said machine comprising:

a rotary roughing tool supported by a tool supporting means, said tool supporting means comprising a carrier movable towards and away from said shoe support, said roughing tool comprising a roughing brush;

said tool support carried by said carrier being movable relative thereto wherein a tool supported thereby can be moved in a direction heightwise of the bottom of said shoe assembly and follow the plan shape of the bottom of said shoe assembly, to operate progressively along the marginal portion of the shoe bottom;

an adjustable resilient means which functions with said tool support to urge said tool into engagement with the bottom of said shoe, wherein movement of said tool in a direction heightwise of said shoe bottom and relative to said carrier is determined by said engagement of said tool with said shoe bottom, the movement varying according to the contour of said shoe bottom, the heightwise position of said carrier with respect to said shoe support being generally constant; said resilient means including a double piston arrangement comprising an upper piston and a lower piston, each having bleed holes through which hydraulic fluid may pass; and a drive means for effecting rotation of said roughing tool comprising a rotary drive member supported on said carrier, a second rotary member on a shaft, on which shaft a tool can be mounted, and an endless drive member interconnecting said rotary members.

2. A machine for roughing the margin of an upper of a shoe margin assembly as recited in claim 1, wherein said pistons have a valve arrangement to provide a damping effect on said tool during upward movement thereof, and to permit an undamped downward movement thereof.

3. A machine for roughing the margin of an upper of a shoe assembly as recited in claim 2, which also comprises:

a brush mounting by which said rotary roughing brushes may be securable on their rotary shafts, said brush mounting comprising a hollow sleeve portion and a locking arrangement at one end thereof, wherein an end cap member can be disposed on said sleeve portion to secure a hub of said brush to said sleeve portion;

said locking arrangement including a latching member accommodated in said sleeve portion, and during machine operation, projects from said sleeve portion to engage and secure said end cap member, and a spring biased locking member which is also disposed in said sleeve portion to hold said latching member in its operative position;

said end cap having an opening permitting access to said locking member, said locking member being retractable against said spring whereupon said latching member may be released out of its operative position and the end cap member may be released from said sleeve portion.

* * * * *